United States Patent [19]

Frankel et al.

[11] Patent Number: 5,045,132

[45] Date of Patent: Sep. 3, 1991

[54] HIGH-ENERGY EXPLOSIVE OR PROPELLANT

[75] Inventors: Milton B. Frankel, Tarzana; Michael A. Cunningham, Thousand Oaks, both of Calif.

[73] Assignee: Rockwell International Corporation, El Segundo, Calif.

[21] Appl. No.: 578,157

[22] Filed: Sep. 6, 1990

[51] Int. Cl.[5] ..... C06B 45/10

[52] U.S. Cl. ..... 149/19.6; 149/88

[58] Field of Search ..... 149/19.6, 88

[56] References Cited

U.S. PATENT DOCUMENTS

| | | | |
|---|---|---|---|
| 4,268,450 | 5/1981 | Frankel et al. | 260/349 |
| 4,269,637 | 5/1981 | Flanagan | 149/19.6 |
| 4,289,551 | 9/1981 | Perrault et al. | 149/19.4 |
| 4,379,903 | 4/1983 | Reed, Jr. et al. | 528/55 |

*Primary Examiner*—Stephen J. Lechert, Jr.

*Attorney, Agent, or Firm*—H. Fredrick Hamann; Harry B. Field; David C. Faulkner

[57] ABSTRACT

High-energetic explosive and propellant compositions having decreased detonation sensitivity are provided. To enhance the specific impulse of these formulations and ensure detonation desensitization, the highly-energetic oxidizer 1,9-dinitrato-2,4,6,8-tetranitrazanonane is utilized.

8 Claims, No Drawings

HIGH-ENERGY EXPLOSIVE OR PROPELLANT

BACKGROUND OF THE INVENTION

1. Field of the Invention

This invention relates to high-energy explosive or propellant compositions, and is particularly directed to energetic formulations having reduced sensitivity to detonation and improved mass impetus.

2. Description of Related Art

High-energy explosives and propellants are generally formulated utilizing a high-energy binder and oxidizer, together with suitable plasticizers. In prior formulations, high-energetic oxidizers such as cyclotetramethylenetetranitramine (HMX) have been utilized. However, such conventional oxidizers when utilized in explosives and solid propellants have detrimentally increased sensitivity to detonation.

BRIEF SUMMARY AND OBJECTS OF THE INVENTION

Accordingly, to maintain or improve the high energy potential or specific performance of explosives or propellant formulations and acceptable impetus levels while concurrently reducing detonation sensitivity, the present invention is directed to performance-improved, less detonation-sensitive formulations.

The advantages of the present invention are realized in explosive and propellant formulations utilizing a select oxidizer in combination with high-energy constituents.

Accordingly, an object of the present invention is to provide improved high-energy explosive and propellant composites.

Another object of the present invention is to provide high-energy explosive and propellant composite compositions having a lessened detonation sensitivity and enhanced specific performance.

These and other objects and features of the present invention will be apparent from the following detailed description.

DETAILED DESCRIPTION OF THE INVENTION

The high-energy explosive and propellant composites or compositions of the present invention are characterized by the utilization of highly energetic and impact desensitized components, including a solid highly-energetic ingredient oxidizer 1,9-dinitrato-2,4,6,8-tetranitrazanonane.

In addition to the aforementioned oxidizer, the propellant formulations or composites of the present invention also contain at least 20% by weight of a highly energetic plasticizer and at least 10% by weight of a polymeric binder, preferably a hydroxy-terminated aliphatic polyether binder. A preferred hydroxy-terminated aliphatic polyether binder (GAP) used in the practice of the present invention is disclosed and claimed in U.S. Pat. No. 4,268,450 incorporated herein by reference.

Known plasticizers which may be utilized in the high-energy explosive or propellant composites taught herein preferably include trimethylolethanetrinitrate and 4,4,4-trinitrobutyl nitrate. The solid highly-energetic oxidizer ingredient 1,9-dinitrato-2,4,6,8-tetranitrazanonane is further characterized in Table I below.

TABLE I

| | |
|---|---|
| NAME: | 1,9-DINITRATO-2,4,6,8-TETRANITRAZANONANE |

TABLE I-continued

| | |
|---|---|
| STRUCTURE: | 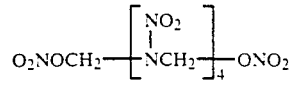 |
| FORMULA: | $C_5H_{10}N_{10}O_{14}$ |
| MOLECULAR WEIGHT: | 434 |
| M.P. (°C.): | 202-203 |
| IMPACT SENSITIVITY: (in-lb) | 28-30 (HMX = 14-15) |
| WEIGHT LOSS %: (112 hrs @ 74° C.) | 0.94 |
| $\Delta H_f$(Kcal/mole): | −55 |

In order to compare the high-energy explosive or propellant composites of the present invention with known composite formulations, Table II is provided hereinbelow. In Table II, formulations utilizing conventional highly-energetic oxidizer cyclotetramethylenetetranitramine (HMX) are compared to formulations utilizing the preferred oxidizer 1,9-dinitrato-2,4,6,8-tetranitrazanonane (DNTNN) in combination with a suitable plasticizer (TMETN/TNBNT) and binder (GAP). As shown, the specific impulse of formulations defined by the use of the preferred highly-energetic oxidizer ingredient of the present invention display a substantially higher specific impulse than the formulations utilizing the conventional HMX.

TABLE II

| FORMULATIONS | | | | | |
|---|---|---|---|---|---|
| HMX | DNTNN | TMETN | TNBNT | GAP | $I_{sp}$ |
| 70 | — | 20 | — | 10 | 253 |
| 70 | — | — | 20 | 10 | 258 |
| — | 70 | 20 | — | 10 | 261 |
| — | 70 | — | 20 | 10 | 265 |

wherein HMX and DNTNN are as defined above; TMETN is trimethylolethanetrinitrate; TNBNT is 4,4,4.trinitrobutyl nitrate; and GAP is glycidyl azide polymer.

Obviously, numerous variations and modifications may be made without departing from the present invention. Accordingly, it should be clearly understood that the embodiments of the present invention disclosed hereinabove are not intended to limit the scope of the present invention.

What is claimed is:

1. A composite for use as a high-energy explosive or propellant comprising:

(a) 1,9-dinitrato-2,4,6,8-tetranitrazanonane; and (b) a polymeric binder.

2. A composite according to claim 1, including a plasticizer.

3. A composite according to claim 1, wherein the ingredient 1,9-dinitrato-2,4,6,8-tetranitrazanonane comprises 70 weight percent of said composite.

4. A composite according to claim 1, wherein said polymeric binder comprises 10 weight percent of said composite.

5. A composite according to claim 1, wherein said polymeric binder is a hydroxy-terminated aliphatic polyether.

6. A composite according to claim 2, wherein said plasticizer is selected from the group consisting of trimethylolethanetrinitrate and 4,4,4-trinitrobutyl nitrate.

7. A composite according to claim 2, wherein said plasticizer comprises 20 weight percent of said composite.

8. In an explosive or propellant comprising a plasticizer, binder and oxidizer, the improvement wherein the oxidizer is 1,9-dinitrato-2,4,6,8-tetranitrazanonane.

* * * * *